US005653115A

United States Patent [19]

Brickley et al.

[11] Patent Number: 5,653,115

[45] Date of Patent: Aug. 5, 1997

[54] AIR-CONDITIONING SYSTEM USING A DESICCANT CORE

[75] Inventors: Stephen C. Brickley, Newbury; Nancy Banks, Beverly, both of Mass.; Larry Klekar, Garden Ridge, Tex.

[73] Assignee: Munters Corporation, Fort Myers, Fla.

[21] Appl. No.: 420,644

[22] Filed: Apr. 12, 1995

[51] Int. Cl.[6] ..... P25D 17/06

[52] U.S. Cl. ..... 62/94; 62/95; 165/4

[58] Field of Search ..... 62/92, 93, 94, 62/95, 271, 304; 165/4, 111, 909

[56] References Cited

U.S. PATENT DOCUMENTS

| | | | |
|---|---|---|---|
| 4,051,898 | 10/1977 | Yoshino et al. | 165/166 |
| 4,180,126 | 12/1979 | Rush et al. | 165/59 |
| 4,429,735 | 2/1984 | Nomaguchi et al. | 165/60 |
| 4,461,344 | 7/1984 | Allen et al. | 165/110 |
| 4,503,907 | 3/1985 | Tanaka et al. | 165/133 |
| 4,738,120 | 4/1988 | Lin | 62/272 |
| 4,873,835 | 10/1989 | Rojey et al. | 62/93 |
| 5,050,391 | 9/1991 | Tsimerman | 62/94 |

*Primary Examiner*—William Doerrler

*Attorney, Agent, or Firm*—Fitzpatrick, Cella, Harper & Scinto

[57] ABSTRACT

A method and apparatus for conditioning air for an enclosure is disclosed in which a stream of outside ambient air is dried in a desiccant core and cooled; thereafter the air stream is further cooled by passing the same over a cooling element whose surface temperature under normal operating conditions is higher than the dew point of the cooled and dried air leaving the heat exchanger. The thus cooled outside air stream is supplied to the enclosure while return air is withdrawn from the enclosure and supplied to desiccant core to pass in heat and moisture exchange relation to the outside air stream in order to remove moisture sorbed by the desiccant material from the outside air stream.

12 Claims, 4 Drawing Sheets

FIG. 2

| | | A | B | C | D | E | F | G | H |
|---|---|---|---|---|---|---|---|---|---|
| SUMMER | AIR FLOW:SCFM | 10000 | 10000 | 10000 | 10000 | 10000 | 10000 | 10000 | 10000 |
| | TEMP:° OF DB | 90 | 78.5 | 55 | - | 58 | 75 | - | 86.3 |
| | HUMIDITY RATIO GR/10 | 110 | 80 | 64 | - | 64 | 70 | - | 100 |
| WINTER | AIR FLOW:SCFM | 10000 | 10000 | 10000 | 10000 | 10000 | 10000 | 10000 | 10000 |
| | TEMP:°OF DB | 10 | 55 | - | 78 | 75 | 70 | - | 25 ° |
| | HUMIDITY RATIO GR / 10 | 5 | 31 | - | 31 | 31 | 40 | - | 14 GR |

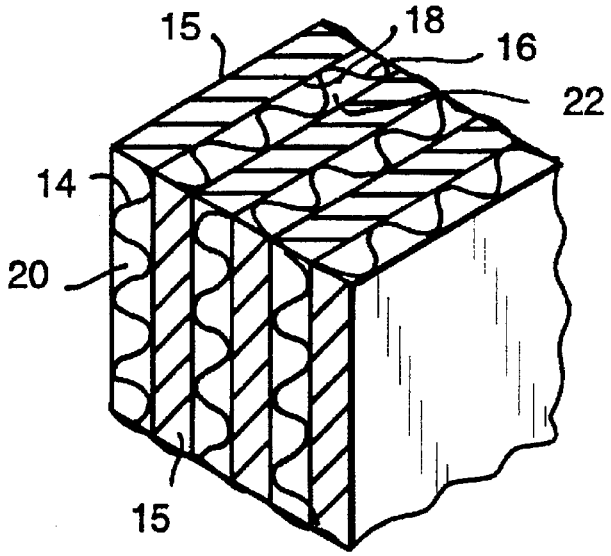
FIG.3
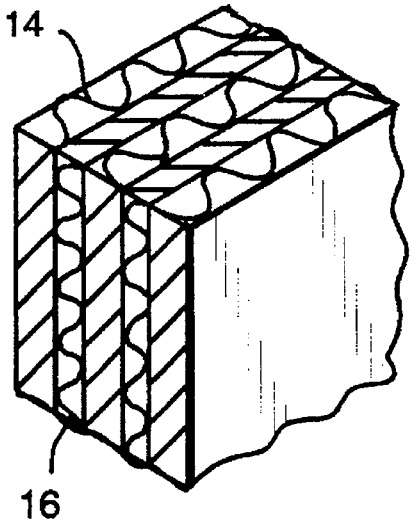
FIG. 4
FIG.6
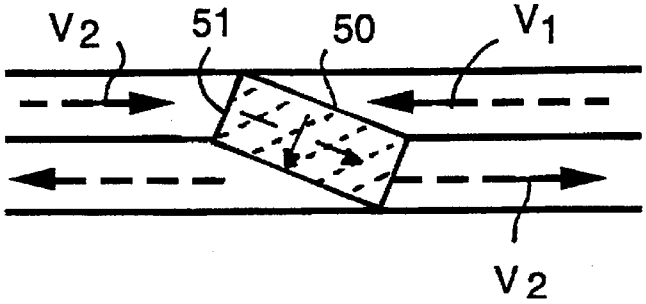

AIR-CONDITIONING SYSTEM USING A DESICCANT CORE

BACKGROUND OF THE INVENTION

1. Field of the Invention

The present invention relates generally to air conditioning systems and more particularly to an air conditioning system which uses a static desiccant core for humidity control and/or dehumidification.

2. The Background of the Invention

Air conditioning systems for cooling air in an enclosed space typically must condense water vapor from an air stream to achieve adequate dehumidification. The result is that the air conditioning system works to maintain temperature control in the space (sensible load) and also must have the capacity to remove the heat of condensation from the water vapor which is extracted from the air stream to maintain the desired level of humidity in the enclosed space (latent load).

It has frequently been found that with previously proposed air conditioning systems the temperature required to condense water vapor in order to maintain the desired humidity in an enclosure is lower than the temperature needed to be maintained within the space itself. Accordingly, it is often necessary to reheat the dehumidified air in order to maintain desired comfort levels. In addition, contemporary indoor air quality requirements have created a demand for large quantities of outside air to be supplied continuously to the enclosed space. This typically means that a greater load is placed on the air conditioning system than was required in the past, making the initial size or capacity of the air conditioning unit greater with attending increased capital and operating costs.

To avoid these excess expenses, air conditioning systems using rotary enthalpy wheels have been previously proposed. Such systems generally reduce the load imposed by outside air on the air conditioning unit by utilizing exhaust air from the enclosed space as a driving force for temperature and moisture transfer from the make-up air to the rotary wheel and then finally to the exhaust air discharge. Such systems have not been found to be satisfactory in practice because of cross-contamination between air streams and because of the complexity of the system. As a result these systems have a poor reputation for reliability and suffer from bearing, drive system and metal fatigue.

In accordance with the present invention an air conditioning system is disclosed in which the return air in the enclosure is exhausted into the atmosphere, but is used first in the process in order to treat outside air being introduced into the enclosure for air exchange purposes. The return air is passed in counter current relationship to the outside air in a fixed desiccant core unit having no moving parts.

It is an object of the present invention to provide an improved air conditioning system based upon desiccant technology.

Another object of the present invention is to provide an improved air conditioning system which is less expensive to construct and to operate as compared to prior art systems.

Yet another object of the present invention is to provide a desiccant based air conditioning system which has greater mechanical reliability and lower risk of cross circuit air contamination due to leakage.

A still further object of the invention is to provide a desiccant based air conditioning system which allows for independent control of temperature and humidity.

SUMMARY OF THE INVENTION

In accordance with an aspect of the present invention an air conditioning system for an enclosure such as a room or the like is provided in which outside air is supplied to an exchange device which is constructed of a desiccant material. The exchange device is formed of corrugated sheets which, in one embodiment, are positioned alternately in crossing relation with flat sheets between them to define first and second perpendicularly arranged sets of passages in the device or core. The desiccant material forming the walls of the exchange device attracts water vapor from a warm and humid air stream (e.g. outside air) while allowing transfer of the sorbed water through the material to an exhaust air stream (e.g. exhaust room air). The exchanger simultaneously transfers thermal energy between the two air streams to reduce the heating or cooling loads imposed on the air conditioning apparatus.

In use, outside air is supplied to one set of passages in the device for humidity and temperature exchange with exhaust room air supplied to the other set of passages. The cooled and dried outside air is then supplied to an air conditioner device which further cools the outside air by passing it over a cooling element whose surface temperature, under normal operation conditions, is higher than the dew point of the outside air from the heat exchanger. As a result of the use of the desiccant core, the air supplied to the air conditioner is relatively dry so the air conditioner can be operated at higher temperatures while avoiding condensation in the air conditioner. It thus operates in its most efficient mode. The exhaust air supplied to the core or exchanger provides a temperature sink for the exchange of thermal energy between the two air streams. The room air from the core or exchanger then may be exhausted to the atmosphere.

Applicant has found that an air conditioner system constructed in accordance with the present invention is less expensive to construct, operate and maintain than an air conditioning system using only an air conditioner device or a combination of an air conditioner device and a rotary enthalpy wheel. By this system the initial capacity of the air conditioner unit can be substantially reduced because of the temperature and moisture exchange through the desiccant core which removes energy from the outside air before it is supplied to the air conditioner. The static nature of the desiccant core eliminates the problems associated with the drive systems, sealing mechanisms and failure of rotating components found in the prior art. The walls of the desiccant exchanger core of the invention allow moisture transfer via internal diffusion while remaining highly impermeable to air flow. The present invention therefore has a very low amount of cross circuit air contamination compared to the prior art wherein seals rub against sliding surfaces to prevent air mixing and wherein purge air streams are required to extract contaminants from the volume of the exchanger rotating between air streams.

In one example, a conventional air conditioning system for cooling outside air may require a 59 ton air conditioner. With the present invention, using a desiccant exchange, the required air conditioner need only be 31 tons. Thus the size of the air conditioner and the power consumption of the system is reduced by almost 50%.

In the preferred embodiment of the invention, as described hereinafter, a cross flow desiccant exchanger is used, however other exchanger configurations, such as counter flow arrangements, could also be used. It is believed that the cross flow configuration provides the best combination of design flexibility, ease of manufacture, and mechanical strength to resist internal air pressure while maintaining high transfer efficiencies.

The above and other objects, features and advantages of this invention will be apparent in the following detailed description of illustrative embodiments thereof, which is to be read in conjunction with the accompanying drawing wherein:

BRIEF DESCRIPTION OF DRAWING

FIG. 2 is a chart showing an example of operating conditions within the system of the present invention wherein outside air temperature is 90° Fahrenheit and enclosure return air is at 75° Fahrenheit;

FIG. 3 is a perspective view of a desiccant core for the air conditioning system constructed in accordance with one embodiment of the invention wherein the corrugations of both sets of sheets are of the same dimensions;

FIG. 4 is a perspective view of another embodiment of exchanger core wherein one set of sheets has smaller corrugations of greater frequency than the other set;

FIG. 6 is a schematic side view of a core pack illustrating another way of forming the core pack.

DETAILED DESCRIPTION

Figure 1:
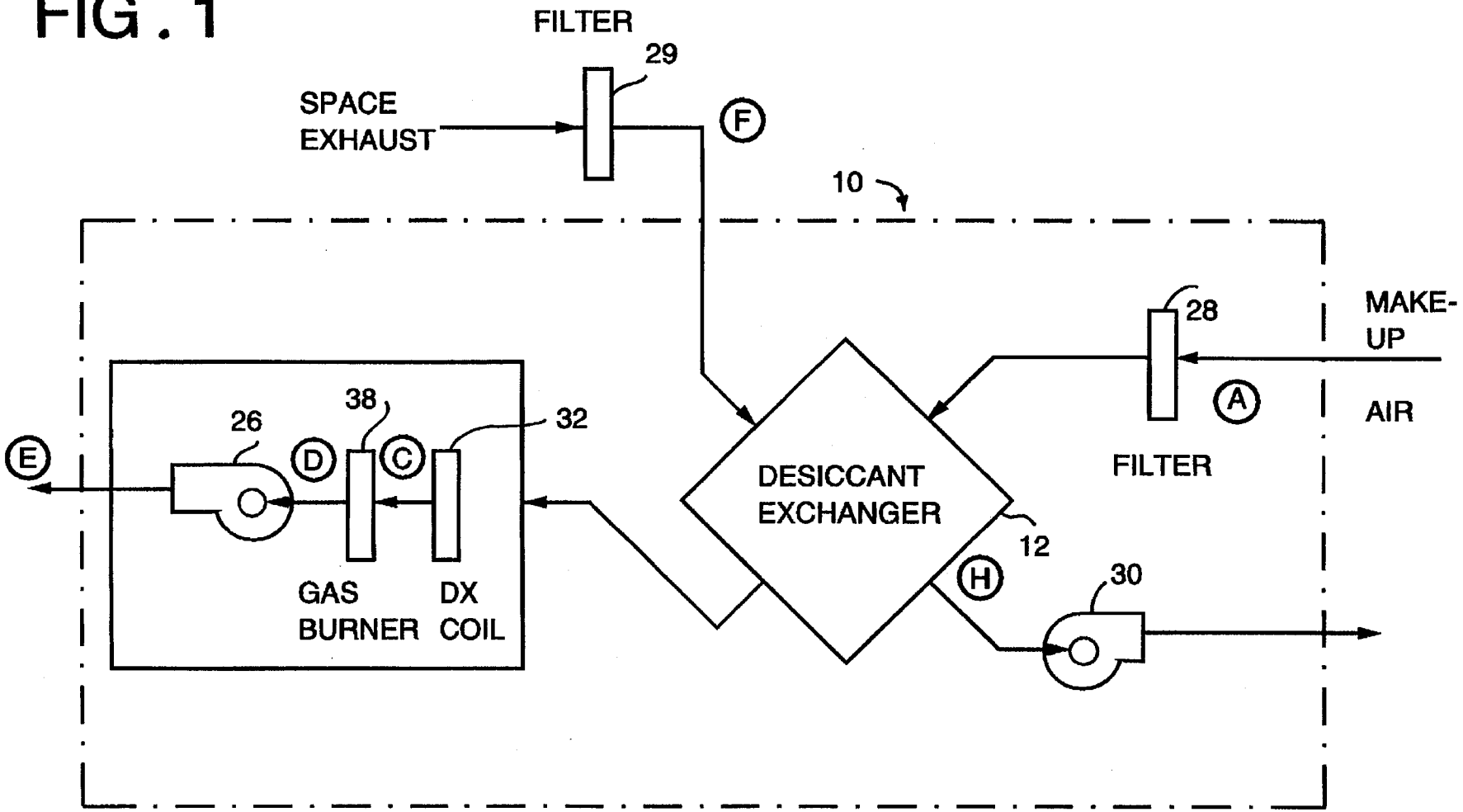
FIG. 1 is the schematic view of an air conditioning system constructed in accordance with the present invention.

Referring now to the drawing in detail, and initially to FIG. 1 thereof, an air conditioning system 10 constructed in accordance with the present invention is illustrated. This system includes a desiccant exchanger core 12 which has no moving parts. The core is formed of desiccant sheet material, such as, for example, desiccant sheet material previously used to form desiccant wheels as sold by Cargocaire Engineering Corporation and by Munters Corporation. Such sheet material can be formed with a silica gel coating, as is known in the art, e.g. U.S. Pat. No. 4,871,607 or with a lithium chloride or other desiccant materials in a known manner. The sheets are preferably formed with a substantially air impervious base material which could, for example, be formed of material sold under the trademarks TYVEK and GORTEX or other known supporting materials. Such materials however permit water vapor transfer between desiccant material on opposite sides thereof.

In one embodiment of the invention core 12 is formed of two sets of corrugated sheets 14 and 16 (see FIG. 5) wherein the sheets of each set are alternated with one another with the corrugations of each adjacent sheet positioned at 90° to each other. A third set of flat sheets 18 of the desiccant material are provided with one flat sheet positioned between each adjacent pair of sheets 14, 16. This arrangement provides first and second sets of perpendicularly related air flow passages 20, 22 in the core to allow two separate air streams to pass through the core in cross flow relationship to one another.

The edges of each sheet of material in sets 14, 16 may be closed by flat sheet sections 15 if desired to completely isolate the two air streams. The sheets are bonded together at their contact points in any known or convenient manner.

In accordance with one embodiment of the present invention ambient or outside air is supplied to the system 10 through an intake duct 24 or the like under the influence of a blower 26 to one set of passages 20 in core 12.

The outside air in this stream is preferably passed through a conventional dust filter 28 or the like before entering the desiccant core 12. As the air passes through the passages 20 of desiccant core 12 moisture is removed from the air.

At the same time enclosure or room return air is withdrawn from the room through a conventional dust filter system 29 by a blower 30 and passes through the passageways 22 of core 12. This return air is cooler and drier than the outside air. It removes moisture sorbed by the desiccant material and also decreases the temperature of the outside air.

The temperature conditions of various stages of the process are depicted on the graph of FIG. 2 for one embodiment of the invention wherein the air flow induced by the blower 26 is 10,000 standard cubic feet per minute, with outside air temperature being 90° Fahrenheit and having a humidity ratio of 110 grains per pound. These are the conditions of the ambient air stream at point A in FIG. 1. As seen from the chart in FIG. 2, after the air passes through the desiccant core, at point B, its temperature has been lowered to 78.5° Fahrenheit and its humidity ratio has been decreased to 80 gr/lb. At the same time the room return air, which is preferably passed first through the dust filter 29 has its temperature raised from 70° F. to 86.3° F. and 70 gr/lb to 100 gr/lb.

From the desiccant core the now slightly cooled and dried stream of outside air is passed to an air conditioner 32, which is of known construction. The air conditioner may be a conventional electrically operated refrigerant based air conditioner having cooling coils over which the air is passed in heat exchange relationship. Because the air has been dried in the desiccant core it is possible to operate the air conditioner unit at higher temperatures than have been previously used in the art because the air conditioner does not have to produce as much dehumidification. Indeed, the air conditioner may operate at a temperature which is higher than the dew point temperature of the air being treated thereby avoiding formation of condensation on the condensation coils. Condensation on the coils would decrease the efficiency of the air conditioner and its ability to cool the air. It also produces undesirable sites for bacterial growth. Of course, while the air conditioner operates at the desired temperature above the dew point of the air flowing from the core during normal on-line operating conditions, it will be understood by those skilled in the art that during initial start up of the air conditioner, before it reaches a steady state condition, there may be some temperature variation.

As a result of the passage of the air through air conditioner 30, its temperature is decreased (point C) to 55° Fahrenheit and its moisture content is also reduced to 64 gr/lb. Blower 26 then supplies the thus cooled air to the room enclosure.

In the illustrative embodiment of FIG. 1, a gas burner or furnace 38 is provided in the air stream between air conditioner 32 and blower 26. This burner is not used in the air conditioning mode of operation of the apparatus of FIG. 1. The burner is used when heated air is required and the air conditioning system is not operating. When operating in the normal air conditioning mode of the present invention the air passes untreated through the burner system. From blower 26 the cooled and dehumidified air is supplied to the room or enclosure where it mixes with air in the enclosure and/or recirculated filtered room air to maintain desired temperature and humidity levels therein.

By this arrangement of the present invention an improved air conditioning system is provided which has fewer moving parts that are subject to failure and which is more efficient in operation. The use of the corrugated desiccant core material provides for efficient heat and humidity transfer by a very simple structure wherein the corrugations of the sheets provide ample air flow through a plurality of separated passageways. The core itself has great structural integrity because of the alternate crossing of the corrugated sheets which is reinforced by the intermediate flat sheets and the bonding of the sheets together.

The air conditioner system of the present invention represents an improved desiccant material based system with substantial efficiencies both in original installation expenses and in operation. As a result the size of the air conditioner needed in the system is reduced.

As described above these systems are used for cooling air supplied to the enclosure. If it is necessary supply heated air to the enclosure, the system operates as described except that instead of the air conditioner 26 being operative, the gas burner is operative. It should be noted that in winter operation the desiccant core helps maintain heat and humidity levels in the enclosed space. This also allows the heater to be reduced on a first cost and operating cost basis.

In the embodiment of the core shown in FIG. 3 the corrugations of sheets 14 and 16 have the same amplitude (or height) and frequency. However, the operating characteristics of the core may be varied by changing the size or configurations of the sheets, thereby to modify the relative volume of air flow in the air passageways 20, 22.

For example, in the embodiment shown in FIG. 4, the sheets 16 are formed with corrugations that have a smaller amplitude and higher frequency than that of sheets 14. Thus the volume of air at a given pressure which can pass through the air passageways 22 formed by sheets 16 will be less than can pass through passages 20.

Figure 5:
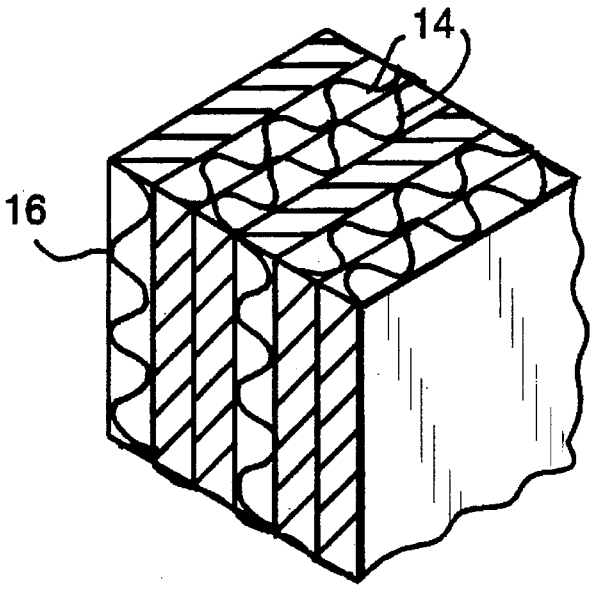
FIG. 5 is a perspective view of yet another embodiment or desiccant core of the invention wherein one set of passages is formed of pairs of sheets of desiccant material arranged parallel to each other.

In the embodiment of FIG. 5 two sheets 14 are placed between each pair of sheets 16, thus doubling the air flow capacity of the air passages 20 formed by sheets 14 as compared to passageways 22.

In the embodiments of FIGS. 3 to 5 the cores 12 are formed as rectangular blocks with the air passageways extending perpendicularly to the edges of the core. With this construction the air ducts carrying the outside and room air streams to the core are arranged to extend perpendicularly to the core. In some situations it may be desirable to have unbalanced air flow circuits in the core. In those cases the core may take an elongated rectangular form, as shown in FIG. 6 so that one face 50 has a larger inlet area for its air stream than the other face 51.

Figure 7:
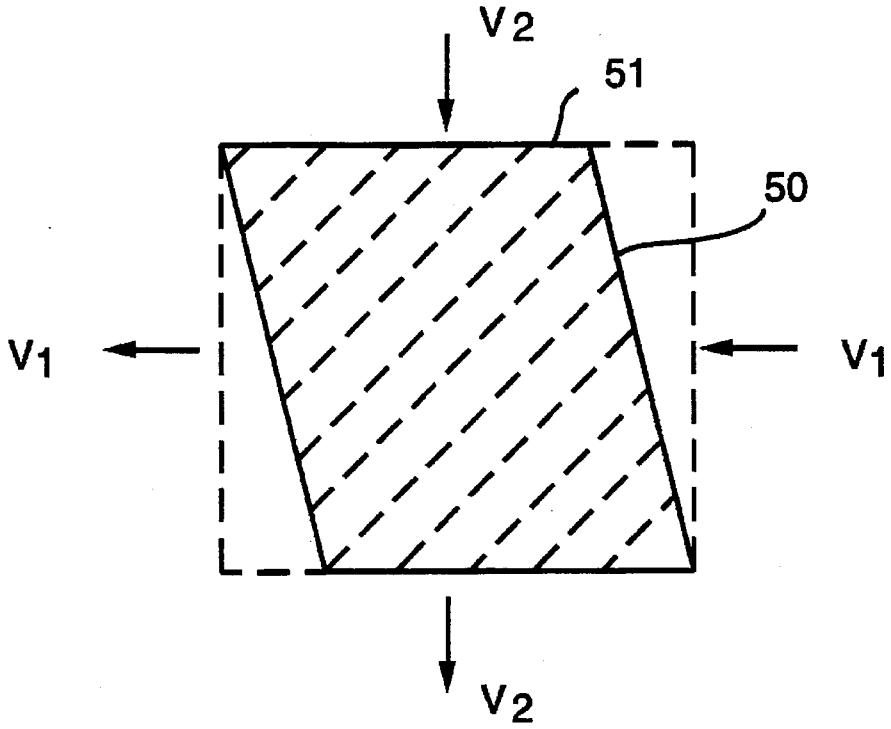
FIG. 7 is a schematic illustration of yet another form of core pack.

An alternative method of creating unequal air flows is to initially form the core with flow paths at 90° angles to the core faces, as seen in FIG. 3 for example, and then re-cutting the core material on one or both pairs of opposed faces at different angles to the flow paths to form a diamond shaped core whose air inlet faces have different areas, as seen in FIG. 7.

Although illustrative embodiments of the present invention have been described herein with reference to the accompanying drawings, it is to be understood that the invention is not limited to those precise embodiments, but that various changes in modifications can be effected therein by those skilled in the art without departing from the scope or spirit of this invention.

What is claimed is:

1. The method of conditioning air for an enclosure which comprises the steps of:

i) drying a first stream of outside ambient air in a fixed desiccant core formed of a plurality of sheets of air impervious corrugated material coated with a desiccant material and defined by two sets of said sheets positioned at angles to each other to define first and second sets of passages in the core positioned at angles to each other, said drying step comprises the steps of passing said first stream of outside ambient air through said first set of passages wherein the desiccant material removes water from said outside ambient air and cooling the dried outside air stream in said first set of passages in the desiccant core;

ii) further cooling the cooled and dried outside air stream by passing the same over a cooling element whose surface temperature under normal operating conditions is higher than the dew point of the cooled and dried first outside air stream leaving the desiccant core;

iii) supplying the cooled outside air stream to said enclosure without further drying in the desiccant core;

iv) passing enclosure return air in heat and moisture exchange relation to said outside air stream in the second set of passages in the fixed desiccant core to remove moisture from the core and to reduce the temperature of the outside air stream, while increasing the temperature of said enclosure return air; and v) exhausting the heated enclosure return air to the atmosphere.

2. Apparatus for conditioning air for an enclosure comprising means for supplying outside ambient air in a first outside air stream to an enclosure; a fixed desiccant core for reducing the moisture content and temperature of said first outside air stream; said desiccant core being formed of first and second sets of air impervious corrugated sheets coated with a desiccant material, said sheets in said first and second sets being positioned at angles to each other, and a third set of flat sheets selectively positioned between sheets of said first and second sets to define independent first and second sets of passageways in said core positioned at angles to each other; air conditioning means downstream of said desiccant core for further cooling of said first outside air stream; said air conditioning means having a cooling element whose surface temperature at normal operating conditions is greater than the dew point of the first outside air stream leaving the heat exchanger; and means for supplying return air from the enclosure to the desiccant core for removing moisture from the core while increasing the temperature of said enclosure return air and for discharging the humidified and heated return air from the core to the atmosphere.

3. Apparatus as defined in claim 2 wherein the corrugations of said first and second sets are positioned at right angles to each other.

4. Apparatus as defined in claim 3 wherein said flat sheets are positioned between each of the sheets in said first and second sets.

5. Apparatus as defined in claim 4 wherein said desiccant material comprises a silica gel desiccant.

6. A desiccant core comprising first and second sets of air impervious corrugated sheet material coated with a desiccant material, said sheets in the first and second sets being positioned at an angle to each other, and a third set of flat sheets of air impervious material also coated with a desiccant material selectively positioned between the sheets of the first and second sets to define first and second sets of passageways in the core which extend at an angle to each other.

7. Apparatus as defined in claim 6 wherein the corrugations of the first and second sets of sheets are positioned at 90° to each other.

8. Apparatus as defined in claim 5 wherein the corrugations of the first and second sets have the same dimensions.

9. Apparatus as defined in claim 5 wherein the corrugations of one of said first and second sets are smaller than the corrugations of the other set.

10. Apparatus as defined in claim 7 wherein one sheet of one of said first and second sets of sheets is positioned between pairs of sheets of the other of said first and second sets of sheets.

11. Apparatus as defined in claim 7 wherein one sheet of said third set of sheets is positioned between each of the sheets of the first and second sets.

12. Apparatus as defined in claim 11 wherein the sheets of said first and second sets include a silica gel desiccant material.

* * * * *